US008661732B2

(12) United States Patent
Kong

(10) Patent No.: US 8,661,732 B2
(45) Date of Patent: Mar. 4, 2014

(54) ELECTRIC DOOR-LOCKING APPARATUS, AND ELECTRIC DOOR COMPRISING SAME

(75) Inventor: You-Sang Kong, Seoul (KR)

(73) Assignee: The Korea Development Bank, Yeongdeungpo-Gu, Seoul (KR)

( * ) Notice: Subject to any disclaimer, the term of this patent is extended or adjusted under 35 U.S.C. 154(b) by 286 days.

(21) Appl. No.: 13/259,901

(22) PCT Filed: Mar. 24, 2010

(86) PCT No.: PCT/KR2010/001817

§ 371 (c)(1),
(2), (4) Date: Sep. 23, 2011

(87) PCT Pub. No.: WO2010/110600

PCT Pub. Date: Sep. 30, 2010

(65) Prior Publication Data

US 2012/0011778 A1 Jan. 19, 2012

(30) Foreign Application Priority Data

Mar. 24, 2009 (KR) ..... 10-2009-0024908

(51) Int. Cl.
*E05B 47/00* (2006.01)
*E05B 65/08* (2006.01)
*E06B 3/70* (2006.01)

(52) U.S. Cl.
USPC ..... 49/118; 49/116; 49/362

(58) Field of Classification Search
USPC ..... 49/116, 118, 360, 362; 105/282.1, 307, 105/308.1, 308.2, 310, 333, 339; 292/9, 12, 292/15, 23, 56, 57, 58, 63, 64, 201, 144, 1, 292/DIG. 1
See application file for complete search history.

(56) References Cited

U.S. PATENT DOCUMENTS 3,318,048 A * 5/1967 Odend Hal ..... 49/223
3,553,890 A * 1/1971 Stretton ..... 49/32

(Continued)

FOREIGN PATENT DOCUMENTS

JP 2004-250946 9/2004
KR 10-0676550 1/2007

OTHER PUBLICATIONS

International Search Report mailed Nov. 3, 2010 for PCT/KR2010/001817.

(Continued)

*Primary Examiner* — Katherine Mitchell
*Assistant Examiner* — Justin Rephann
(74) *Attorney, Agent, or Firm* — Heedong Chae; East West Law Group

(57) ABSTRACT

The present invention provides an electric door-locking apparatus, and an electric door comprising same. The electric door-locking apparatus according to the present invention comprises: a locking switch arranged at a door frame to check the locked status of an electric door body when the electric door body is closed; a screw rotatable in the forward and backward directions; a locking roller guide arranged at the door frame in the vicinity of the screw; and a sliding unit, one end of which is rotatably connected to the screw and the other end of which is connected to the electric door body. The electric door-locking apparatus according to the present invention has a structure which enables simple and easy operation, improves the reliability of the locking function, reduces the risk of failure and erroneous operation, and enables easy manufacture and maintenance to reduce manufacturing costs and maintenance costs as compared to conventional apparatuses.

12 Claims, 4 Drawing Sheets

(56) References Cited

U.S. PATENT DOCUMENTS

| | | | | | |
|---|---|---|---|---|---|
| 4,091,570 | A | * | 5/1978 | Favrel | 49/118 |
| 4,108,283 | A | * | 8/1978 | Mangel | 187/319 |
| 4,142,326 | A | * | 3/1979 | Schmitz | 49/118 |
| 4,198,786 | A | * | 4/1980 | Monot | 49/362 |
| 4,454,931 | A | * | 6/1984 | Leiner et al. | 187/319 |
| 4,457,108 | A | * | 7/1984 | Kuschel et al. | 49/213 |
| 4,605,108 | A | | 8/1986 | Monot | |
| 4,882,876 | A | * | 11/1989 | Daugirdas | 49/141 |
| 4,901,474 | A | * | 2/1990 | Bayard et al. | 49/26 |
| 5,077,938 | A | | 1/1992 | Moreuil | |
| 5,148,631 | A | * | 9/1992 | Bayard et al. | 49/449 |
| 5,263,280 | A | * | 11/1993 | Dilcher | 49/212 |
| 5,341,598 | A | * | 8/1994 | Reddy | 49/362 |
| 5,456,504 | A | * | 10/1995 | Brillant | 292/63 |
| 5,483,769 | A | * | 1/1996 | Zweili | 49/118 |
| 5,755,060 | A | * | 5/1998 | Zweili | 49/449 |
| 5,826,377 | A | * | 10/1998 | Simson et al. | 49/362 |
| 5,893,236 | A | * | 4/1999 | Krbec et al. | 49/118 |
| 5,927,015 | A | * | 7/1999 | Ghosn et al. | 49/291 |
| 6,009,668 | A | * | 1/2000 | Reddy | 49/280 |
| 6,032,416 | A | * | 3/2000 | Springer et al. | 49/119 |
| 6,094,867 | A | * | 8/2000 | Reddy | 49/280 |
| 6,134,838 | A | * | 10/2000 | Reddy | 49/362 |
| 6,189,265 | B1 | * | 2/2001 | Fink | 49/118 |
| 6,282,970 | B1 | * | 9/2001 | Oakley | 74/89.14 |
| 6,446,389 | B1 | * | 9/2002 | Heffner et al. | 49/280 |
| 6,662,500 | B2 | * | 12/2003 | Inage | 49/116 |
| 6,688,042 | B2 | * | 2/2004 | Stojc et al. | 49/118 |
| 6,718,694 | B2 | * | 4/2004 | Stojc et al. | 49/362 |
| 6,739,092 | B2 | * | 5/2004 | Heffner et al. | 49/285 |
| 6,854,399 | B2 | * | 2/2005 | Inage | 105/341 |
| 6,863,001 | B2 | * | 3/2005 | Inage | 105/341 |
| 6,941,701 | B2 | * | 9/2005 | Inage | 49/449 |
| 7,004,516 | B2 | * | 2/2006 | Stojc | 292/201 |
| 7,971,391 | B2 | * | 7/2011 | Harie | 49/120 |
| 8,113,552 | B2 | * | 2/2012 | Ritt et al. | 292/201 |
| 8,136,299 | B2 | * | 3/2012 | Inage | 49/118 |
| 2006/0174540 | A1 | * | 8/2006 | Oberleitner | 49/118 |
| 2011/0041408 | A1 | * | 2/2011 | Lopez Saez et al. | 49/260 |
| 2011/0308164 | A1 | * | 12/2011 | Terasaki et al. | 49/360 |
| 2012/0011778 | A1 | * | 1/2012 | Kong | 49/503 |
| 2012/0073208 | A1 | * | 3/2012 | Lee | 49/449 |

OTHER PUBLICATIONS

Written Opinion of the ISA for international application No. PCT/KR2010/001817, dated Nov. 3, 2011.

* cited by examiner

ELECTRIC DOOR-LOCKING APPARATUS, AND ELECTRIC DOOR COMPRISING SAME

CROSS REFERENCE TO RELATED APPLICATION

This application claims the priority of Korean Patent Application No. 10-2009-0024908, filed on Mar. 24, 2009, in the KIPO (Korean Intellectual Property Office), the disclosure of which is incorporated herein in their entirety by reference. Further, this application is the National Phase application of International Application No. PCT/KR2010/001817, filed Mar. 24, 2010, which designates the United States and was published in Korean. Each of these applications is hereby incorporated by reference in their entirety into the present application.

BACKGROUND OF THE INVENTION

1. Field of the Invention

The present invention relates, in general, to an electric door lock and an electric door having the same and, more particularly, to an electric door lock which has a simple structure, ensures the reliability of a locking function, reduces a danger of a failure and an operation error, and is easy to fabricate and maintain, saving the cost for the fabrication and maintenance relative to the cost taken in the related art, and an electric door having the same.

2. Description of the Related Art

In case of a railway train, a currently available electric door (auto door) is operated such that when a train arrives at a station, the door is opened and closed for boarding or alighting of passengers following the driver's manipulation of an actuation switch, which is performed by the driver who is seeing the passengers boarding on or alighting from the railway train.

Here, if a passenger or an object gets caught in the door during the closing of the electric door, the electric door cannot be completely closed. In this case, the driver is informed of such situation or information through a display or an alarm means, and the driver who recognized the state of the door being not completely closed repeatedly manipulates the actuation switch to open and close the electric door until the electric door is completely closed.

In the meantime, if the railway train is stopped to run owing to a fire, a failure, etc. of the train, or passengers should escape from the train because an emergency situation occurs in the train, the driver should directly manipulate the actuation switch to open the door after checking the state of the railway tracks, or otherwise the passengers should directly manually manipulate a manual opening/closing means, which was mounted in the proximity of the electric door, to open the door.

However, if the situation is that the railway train is running, or the state of the railway tracks is dangerous, or otherwise if nevertheless the situation is not an emergency state, the passengers can open the electric door even with their less effort, a very dangerous situation can be caused. Thus, there is a need for an electric door lock providing a reliable locking operation.

In order to provide a reliable locking function, a conventional electric door lock, which was disclosed in U.S. Pat. No. 5,077,938, includes a locking roller, a locking finger member, a guide finger member, a locking roller slide channel, a roller keeper, a carriage, and the like.

However, the conventional electric door lock having the above-mentioned configuration has a problem of increased cost of fabrication and maintenance because of numerous, complex parts.

SUMMARY OF THE INVENTION

Accordingly, the present invention has been made keeping in mind the above problems occurring in the related art, and the present invention is intended to propose to an electric door lock which has a simple structure, ensures the reliability of a locking function, reduces a danger of a failure and an operation error, and is easy to fabricate and maintain, saving the cost for the fabrication and maintenance relative to the cost taken in the related art, and an electric door having the same.

In order to achieve the above object, according to one aspect of the present invention, there is provided an electric door lock including: a locking switch provided in a door frame for checking the locking state of a door body when the door body is closed, the door frame slidably supporting at least one door body; a pair of screws capable of rotating forwards and rearwards and disposed parallel with each other in one side of the door frame in the direction towards which the door body slides; a locking roller guide provided in the door frame in the proximity of the screws; and a slide unit wherein one end thereof is rotatably connected to the screw and the other end thereof is connected to the door body, the slide unit including a locking switch-pressing plate actuated to operate the locking switch when the door body is closed, such that a locking signal is generated by the locking switch, and a locking roller acting in combination with the locking roller guide.

The locking roller guide includes: a guide body; an inclined section provided at a certain angle on one surface of the guide body to define a path along which the locking roller rolls, the angle being defined in the direction towards which the door body is closed; and a vertical end formed at the utmost position of the inclined section such that the vertical end extends in the direction that intersects the direction in which the door body slides.

According to the electric door lock of the present invention, when the door body is closed, the locking switch-pressing plate is actuated to operate the locking switch in response to the interaction between the locking roller and the locking roller guide. When the locking roller that is moving on the inclined section of the locking roller guide passes through the utmost position of the inclined section of the locking roller guide, it falls down towards the vertical end so that the locking roller comes into contact with or confronts the vertical end of the locking roller guide. In the state of the locking roller being brought into contact with or confronting the vertical end, even if force is exerted to manually open the door, the door cannot be opened because the motion of the locking roller is resisted by the vertical end of the locking roller guide.

The locking roller is elastically biased towards the direction against which the locking roller approaches the locking roller guide.

The sliding unit may include: a screw nut that is rotatably screw-coupled to the screw such that it is movable in the longitudinal direction of the screw; a screw nut lump that surrounds and supports the screw nut and to which the locking switch-pressing plate and the locking roller are connected at one side; and a screw nut lump housing that partially surrounds and supports the screw nut lump such that the screw nut lump can be rotated at a certain angle.

The screw nut lump housing may include: a housing body; an opening that is formed to one side of the housing body such that the locking switch-pressing plate is open towards the locking switch; and a through-passage that is formed in one side of the housing body to allow a support for the locking roller, which connects and supports the locking roller and screw nut lump, to move therethrough.

The through-passage may be composed of a long hole through which the locking switch-pressing plate reciprocates between the switch-off position where the door body is opened so that the locking switch is not actuated and the switch-on position where the door body is closed so that the locking switch is actuated.

The sliding unit may further include: a hanger connected with the door body; a guide roller connected to one side of the hanger and coupled to a guide rail formed on the door frame such that it is able to roll along the guide rail; and a link that connects and supports the other side of the hanger and the screw nut lump housing.

The sliding unit may further include a hinge pin that is coupled to the screw nut lump housing and the link such that it rotatably supports the screw nut lump housing in connection with the link.

The door body, the locking switch, the screw, the locking roller guide, and the sliding unit may be respectively provided in a single unit or a pair unit, in which both elements are symmetric with each other, on the door frame. If they are respectively provided in a pair unit, the opposite screws may respectively have threads extending opposite to each other.

The electric door lock may further include a closing switch provided in the door body so as to generate a signal indicative of the locked state of the door body when the door body was closed.

A space in which the screw nut lump can move in the sliding direction of the door body or in the direction that intersects the sliding direction in connection with the screw nut lump housing may be further provided between the screw nut lump and the screw nut lump housing.

In another aspect of the present invention, there is provided an electric door having the electrical door lock having the above-mentioned configuration.

As set forth before, the electric door lock has a simple structure, ensures the reliability of a locking function, reduces a danger of a failure and an operation error, and is easy to fabricate and maintain, saving the cost for the fabrication and maintenance relative to the cost taken in the related art.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
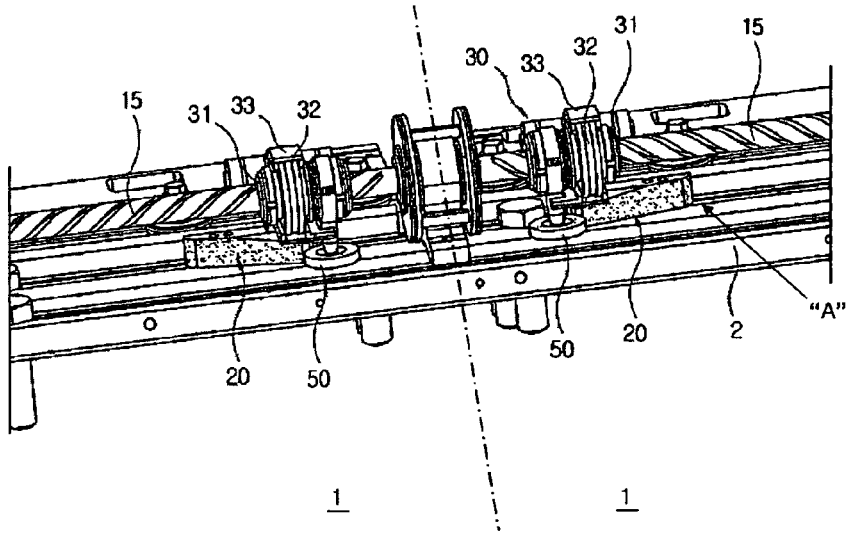
FIG. 1 is a partially enlarged perspective view of an embodiment of an electric door lock that is viewed from upside.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
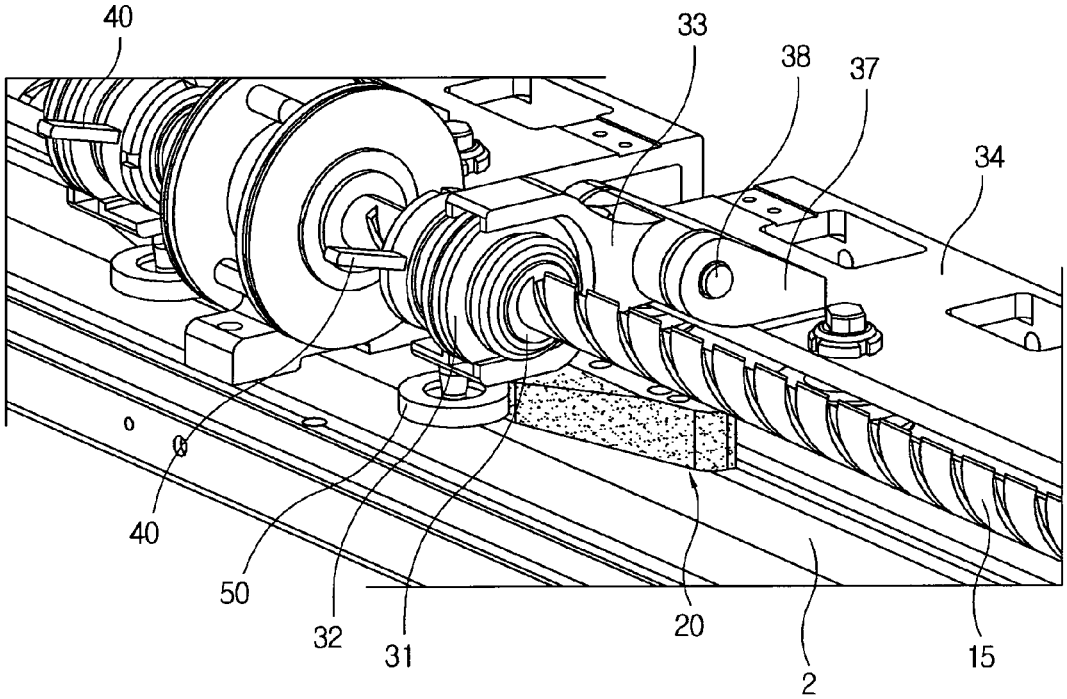
FIG. 2 is a partially enlarged perspective view of a major part of the electric door lock that is viewed in the direction A of FIG. 1.
Figure 3:
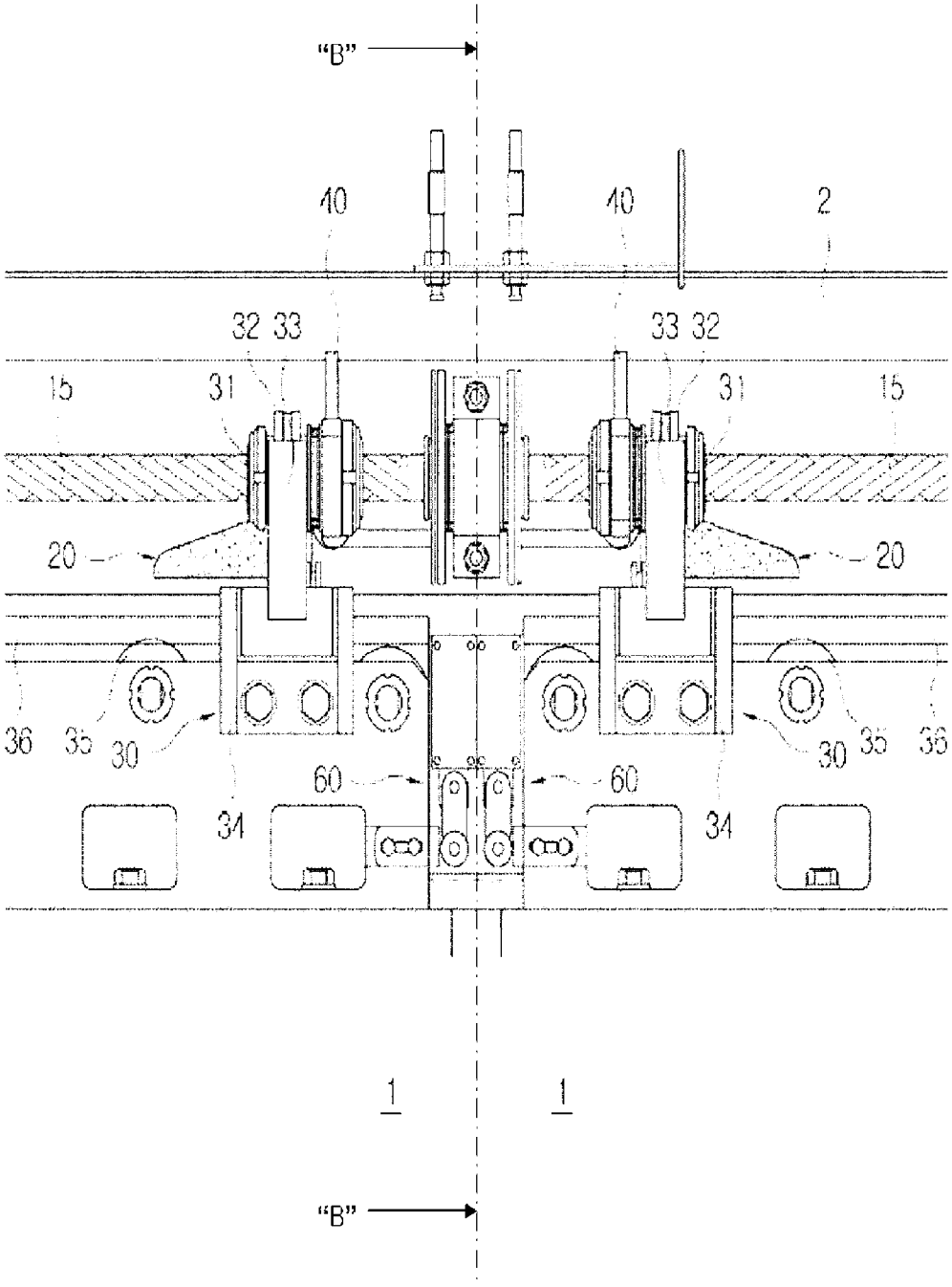
FIG. 3 is a front view of the electric door lock.
Figure 4:
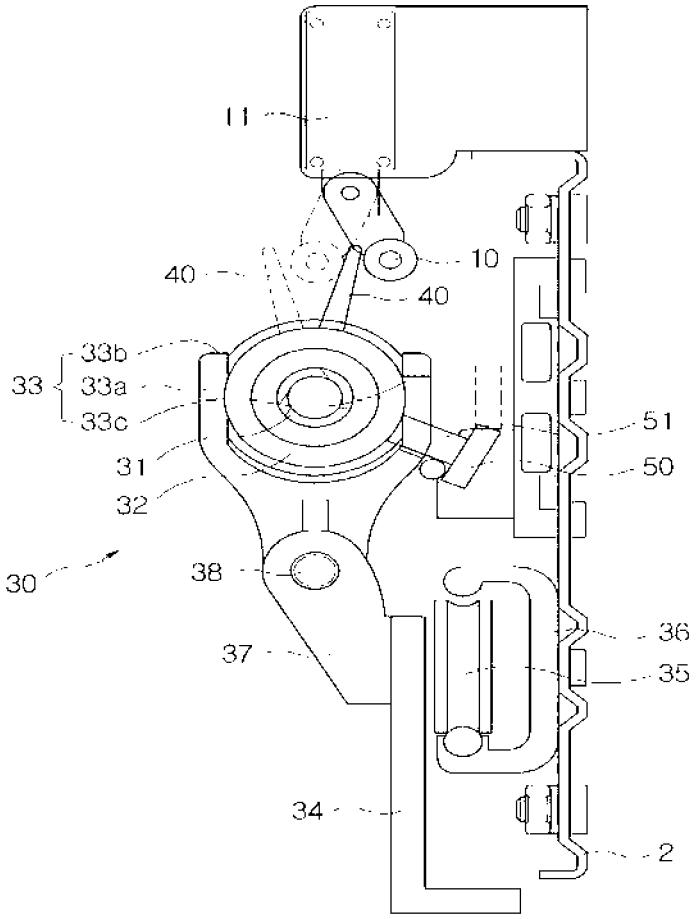
FIG. 4 is a view of the electric door lock that is viewed in line B-B of FIG. 3.
Figure 5:
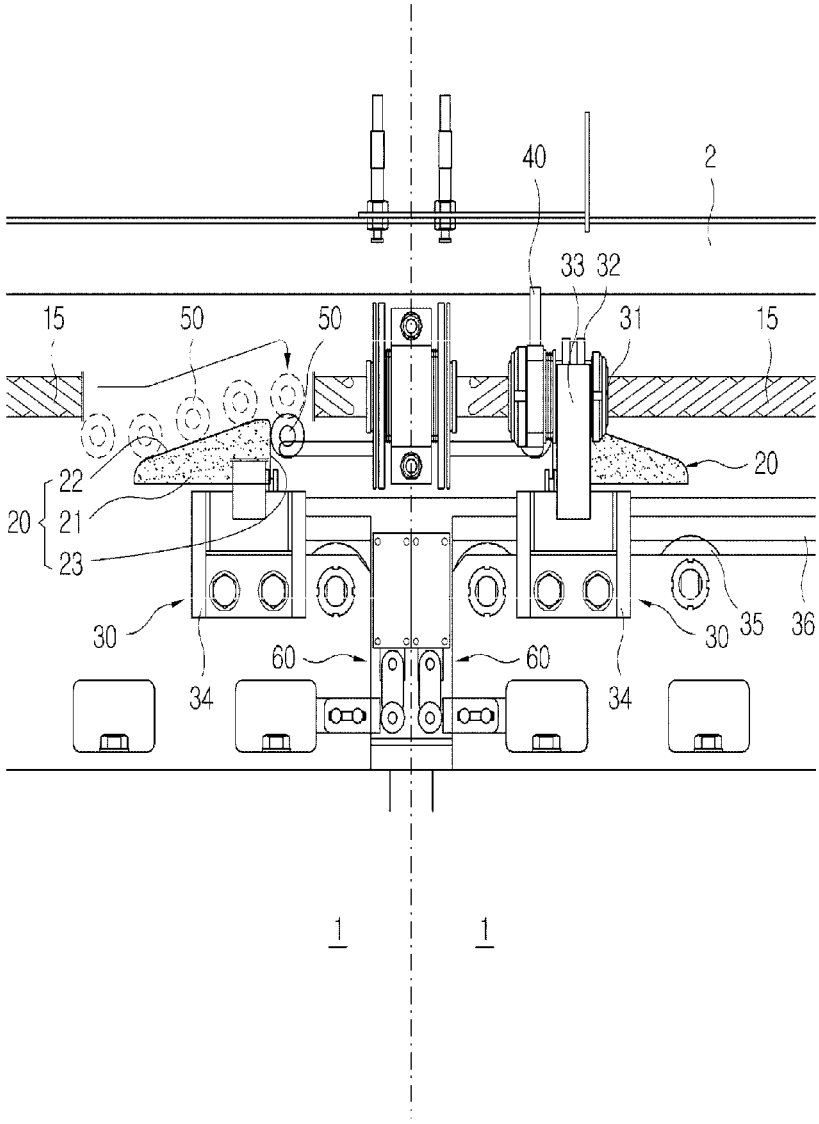
FIG. 5 is a view that is partially cut from FIG. 3 to explain the operation of a locking roller of the electric door lock.

FIG. 1 is a partially enlarged perspective view of an embodiment of an electric door lock that is viewed from upside, FIG. 2 is a partially enlarged perspective view of a major part of the electric door lock that is viewed in the direction A of FIG. 1, FIG. 3 is a front view of the electric door lock, FIG. 4 is a view of the electric door lock that is viewed in line B-B of FIG. 3, and FIG. 5 is a view that is partially cut from FIG. 3 to explain the operation of a locking roller of the electric door lock.

As shown in FIGS. 1 to 5, the electric door lock includes a locking switch 10 provided in a door frame 2 for checking the locking state of a door body 1 when the door body is closed, wherein the door frame slidably supports the door body, a pair of screws 15 capable of rotating forwards and rearwards and disposed parallel with each other in one side of the door frame 2 in the direction towards which the door body 1 slides, a locking roller guide 20 provided in the door frame 2 in the proximity of the screws 15, and a slide unit 30 having a locking switch-pressing plate 40 and a locking roller 50 wherein one end thereof is rotatably connected to the screw 15 and the other end thereof is connected to the door body 1. Here, when the electric door body 1 is closed, the locking roller 50 interacts with the locking roller guide 20 to drive the locking switch-pressing plate 40, thereby actuating the locking switch 10.

According to the electric door lock, when the electric door body 1 is being closed in response to the forward or rearward rotation of the screw 15, as shown in FIG. 5, the locking roller 50 moves along an inclined section 22 of the locking roller guide 20 (see the dotted line of FIG. 5) so that when the locking roller 50 falls down towards a vertical end 23 (downwards in FIG. 5) at the utmost position of the inclined section 22, a screw nut lump 32 rotates at a certain angle in a screw nut lump housing 33, thereby rotating the locking switch-pressing plate 40 from the position of the dotted line to the position of the solid line of FIG. 4. With the actuation of the locking switch 10 by the rotation of the locking switch-pressing plate 40 from the position of the dotted line to the position of the solid line, the locking switch 10 generates a locking signal. In this case, since the locking roller 50 has been disposed against and been engaged with the vertical end 23, even though passengers intend to open the electric door body 1, the electric door body 1 can be held in the locked state.

As shown in FIG. 4, the locking switch 10 is coupled to a connection block 11, which is connected to the upper portion of the door frame 2. Since the locking switch 10 may be adapted to a pressure-sensitive sensor that is actuated by the operation, i.e. the pressing of the locking switch-pressing plate 40, thereby generating the locking signal, it may preferably be rotatably coupled to the connection block 11.

The screw 15 is an element that transmits a practical driving force from a motor to the electric door body 1 in order to open or close the electric door body 1.

In the present embodiment, since a pair (set) of electric door bodies 1 is provided, a pair of screws 15 is also provided. Here, sine the pair of electric door bodies 1 is opened or closed in opposite directions to each other, the pair of screws 15 has threads that extend in opposite directions to each other. That is, in FIGS. 2 and 3, the left side screw 15 has the right-side thread, whereas the right side screw 15 has the left-side thread. Since such screws 15 transmit a practical driving force to the electric door body 1, they are connected to a drive shaft (not shown) of the motor in order to rotate forwards or rearwards. For reference, opening/closing of the door may be manually controlled by a user, or otherwise may be automatically controlled.

The sliding unit 30 is a unit wherein one end thereof is rotatably connected to the screw 15 and the other end thereof is connected to the door body 1, serving to open/close the door body 1 following the transmission of the rotating power of the screw 15 that is rotating to the door body 1.

The sliding unit 30 includes a screw nut 31 that is rotatably screw-coupled to the screw 15 such that it is movable in the longitudinal direction of the screw 15, a screw nut lump 32 that surrounds and supports the screw nut 31, a screw nut lump housing 33 that partially surrounds and supports the screw nut lump 32 such that the screw nut lump can be rotated at a certain angle, a link 37, and a hanger 34.

The screw nut 31 is an element that is screw-coupled to the screw 15. Thus, as the screw 15 rotates, the screw nut 31 connected to the side of the door body 1 can be move along the longitudinal direction of the screw 15. As such, the screw nut 31 can move along the longitudinal direction of the screw 15, so that the door body 1 connected to the screw nut 31 can also be actuated.

The screw nut lump 32 is an element that surrounds and supports the screw nut 31 and to which the locking switch-pressing plate 40 and the locking roller 50 are connected.

Between the screw nut lump 32 and the screw nut lump housing 33, there is further provided a space (not shown) in which the screw nut lump 32 can move in the sliding direction of the door body 1 or in the direction that intersects the sliding direction in connection with the screw nut lump housing 33. Thus, when the door body 1 is operated to slide, the screw nut lump 32, to which the locking switch-pressing plate 40 and the locking roller 50 are connected, can be smoothly operated without interruption. This helps securing reliability of a locking function. Here, the space is not greatly formed, but may suffice if it is of the size that the screw nut lump 32 can freely move in the screw nut lump housing 33.

The sliding unit 30 of the present embodiment advantageously has a very simple configuration because in addition to detailed elements described below, the locking switch-pressing plate 40 that actuates the locking switch 10 and the locking roller 50 that interacts with the locking roller guide 20 are formed into a single piece.

More specifically, according to the present embodiment, since most parts other than the locking switch 10, the screws 15, and the locking roller guide 20 are integrated with the sliding unit 30, the door lock may have a simple structure, ensure the reliability of a locking function, reduce a danger of a failure and an operation error, and be easy to fabricate and maintain, saving the cost for the fabrication and maintenance relative to the cost taken in the related art.

Then a description will be made of the operation of the locking switch-pressing plate 40 actuated by the interaction between the locking roller guide 20 and the locking roller 50.

Referring to FIG. 4, it is noted that when the locking switch-pressing plate 40 pushes the locking switch 10 from the position of the dotted line to the position of the solid line, the locking switch 10 is pushed at a certain angle on the connection block 11, generating a single.

Naturally, this is only one embodiment. That is, while the present embodiment has illustrated the configuration in which when the door body 1 is closed, the locking switch-pressing plate 40 is concurrently rotated to actuate the locking switch 10, alternative embodiment is possible in which the locking switch 10 is disposed as a proximity sensor at the position closer to the door frame 2 than the position of FIG. 4, so that when the locking switch-pressing plate 40 rotates and approaches the locking switch 10, the locking switch can then only generate a locking signal. However, so long as when the door body 1 is closed, the reliability of the locking function can be secured, any method may be adapted.

The locking roller guide 20 interacts with the locking roller 50 such that when the door body 1 is closed, the locking switch-pressing plate 40 actuates the locking switch 10 in response to the rotation of the screw 15.

As described before, the locking switch-pressing plate 40 serves to actuate the locking switch 10 when the door body 1 is closed, generating the locking signal, and the locking roller 50 interacts with the locking roller guide 20 to allow the locking switch-pressing plate 40 to actuate the locking switch 10. In this case, the locking roller 50 may be configured such that it is elastically biased towards the direction in which it moves towards the locking roller guide 20. Since the structure for this configuration is simply provided so that an elastic spring (not shown), which can be mounted to the screw nut lump 32, is disposed to be actuated to allow the locking roller 50 to be elastically actuated against the locking roller guide 20, the structure will be omitted in the figures.

The screw nut lump housing 33 is an element that partially surrounds and supports the screw nut lump 32. Here, since the screw nut lump 32 and the locking roller 50 are operated, i.e. rotated in the state of being connected to the screw nut lump housing so as to actuate the locking switch 15 or interact with the locking roller guide 20, the screw nut lump housing 33 is provided such that it does not interfere with the operation of the screw nut lump 32 and the locking roller 50.

The screw nut lump housing 33 includes a housing body **33*a*, an opening 33*b* that is formed to one side of the housing body 33*a* such that the locking switch-pressing plate 40 is open towards the locking switch 10, and a through-passage 33*c* that is formed in one side of the housing body 33*a* to allow a support 51 for the locking roller, which connects and supports the locking roller 50 and screw nut lump 32**, to move therethrough.

As shown in FIG. 4, the side of the screw nut lump housing 33 may have the shape of a substantially Y form. Particularly, the through-passage **33*c* is composed of a long hole 33*c* through which the locking switch-pressing plate 40 reciprocates between the switch-off position (dotted line in FIG. 4) where the door body 1 is opened so that the locking switch 10 is not actuated and the switch-on position (solid line in FIG. 4) where the door body 1 is closed so that the locking switch 10** is actuated.

That is, the length or size of the long hole **33*c* can be determined within a range by which the locking switch-pressing plate 40 can reciprocate between the switch-off position (dotted line in FIG. 4) and the switch-on position (solid line in FIG. 4**).

In order for the locking switch-pressing plate 40 to actuate the locking switch 10 when the door body 1 is closed, the screw nut lump 32, to which the locking switch-pressing plate 40 is connected, should be rotated at a certain angle in the screw nut lump housing 33. To this end, the locking roller 50 and the locking roller guide 20 are provided wherein the locking roller 50 is a simple circular roller connected to the support 51 for the locking roller, whereas the locking roller guide 20 has a structural characteristic as follows.

As shown in FIG. 5, the locking roller guide 20 includes a guide body 21, an inclined section 22 provided at a certain angle on one surface of the guide body 21 to define a path along which the locking roller 50 rolls, the angle being defined in the direction towards which the door body 1 is closed, and a vertical end 23 formed at the utmost position of the inclined section 22 such that the vertical end extends in the direction that intersects the direction in which the door body 1 slides. In order to allow the locking roller 50 to smoothly interact with the locking roller guide 20, the boundary between the inclined section 22 and the vertical end 23 may be formed into a round.

Thus, when the electric door body 1 is being closed in response to the forward or rearward rotation of the screw 15, as shown in FIG. 5, the locking roller 50 moves along an inclined section 22 of the locking roller guide 20 (see the dotted line of FIG. 5) so that when the locking roller 50 falls down towards a vertical end 23 (downwards in FIG. 5) at the utmost position of the inclined section 22, a screw nut lump 32 rotates at a certain angle in a screw nut lump housing 33, thereby rotating the locking switch-pressing plate 40 from the position of the dotted line to the position of the solid line of FIG. 4.

With the actuation of the locking switch 10 by the rotation of the locking switch-pressing plate 40 from the position of the dotted line to the position of the solid line, the locking switch 10 generates a locking signal. In this case, since the locking roller 50 has been disposed against the vertical end 23, even though passengers intend to manually open the electric door body 1, the electric door body 1 can be held in the locked state.

In order to open the electric door body 1, the screw 15 is actuated such that it rotates rearwards. In this case, due to strong torque initially occurring upon reverse rotation of the screw 15, the locking roller 50 disengages from the vertical end 23 and in turn moves along the inclined section 22, so that the electric door body 1 can be opened without interference.

In addition to the above-mentioned construction, the sliding unit 30 may further include a hanger 34 connected with the door body 1, a guide roller 35 connected to one side of the hanger 34 and coupled to a guide rail 36 formed on the door frame 2 such that it is able to roll along the guide rail 36, a link 37 that connects and supports the other side of the hanger 34 and the screw nut lump housing 33, and a hinge pin 38 that is coupled to the screw nut lump housing 33 and the link 37 such that it rotatably supports the screw nut lump housing 33 in connection with the link 37.

When the electric door body 1 is opened/closed, while the electric door body 1 moves along an axis of the screw 15, the guide roller 35 rolls along the guide rail 36 formed on the door frame 2, so that the electric door body 1 can be smoothly opened/closed.

In addition, the hinge pin 38 serves to partially compensate for vibrations of the door body 1 when the door body 1 is opened/closed particularly in the state of FIG. 4. That is, since the guide roller 50 and the screw nut lump housing 33 are rotatably connected to each other by the hinge pin 38, even when the door body 1 shakes with vibrations in the state shown in FIG. 4, the door body 1 can be smoothly opened/closed.

In the present embodiment, the door frame 2 is an attachment plate that fixes the door body 1 such that the door body can be slidably moved. The door frame 2 may be made from a metal frame for securing certain hardness.

Referring to FIGS. 3 and 5, the electric door body 1 further includes a closing switch 60 that is provided in order to generate a signal indicative of the locked state of the door body 1 when the door body 1 has been closed. The closing switch 60 is a sensor that only generates a signal that is indicative of the locked state of the door body 1 and the closing switch generates the signal before the locking signal is generated by the locking switch 10, and transmits it to the user. Consequently, the user receives both the signal indicative of the locked state and generated by the closing switch 60 and the locking signal generated by the locking switch 10, and then the motor is stopped to actuate the screw 15 to rotate, thereby completing the closing stroke.

Subsequently, a description will be made of the operation of the electric door lock having the above-mentioned configuration with reference to FIGS. 4 and 5. Here, the description will be performed by exemplifying a railway train.

When the screw 15 rotates forwards or rearwards by the driving force from the motor, the door body 1 is concurrently opened/closed.

That is, as shown in FIG. 5, when the locking roller 50, which is moving along the door body 1 such that it moves along the inclined section 22 of the locking roller guide 20 in the region of the locking roller guide 20 (see the dotted line of FIG. 5), then only falls down towards and engages with the vertical end 23 at the utmost position of the inclined section 22, the screw nut lump 32 rotates at a certain angle in the screw nut lump housing 33.

Thus, the locking switch-pressing plate 40, which is connected to the screw nut lump 32, rotates from the position of the dotted line to the position of the solid line of FIG. 4 in the direction in which the screw nut lump 32 rotates, thereby allowing the locking switch-pressing plate 40 to actuate the locking switch 10. Thus, the locking switch 10 generates a locking signal, which in turn is transmitted to a user, making the locking stroke of the door completed.

Of course, this stage is a stage that finally checks the locked state, so that the signal indicative of the locked state and generated by the closing switch 60 was already transmitted to the user before the locking signal is generated.

When the signal indicative of the locked state and generated by the closing switch 60 and the locking signal generated by the locking switch 10 are transmitted to a user's control system, the closing stroke of the door is then only completed. Here, since the locking roller 50 is already in the state of being disposed towards the vertical end 23, even though the passengers intend to open the door body 1, the door body 1 is still held in the locked state so that the door body 1 cannot be opened.

In the meantime, in order to open the door, the screw 15 is actuated such that it rotates rearwards following the rearward rotation of the motor shaft. In this case, due to rearward torque occurring upon reverse rotation of the screw 15, the locking roller 50 disengages from the vertical end 23 and in turn moves along the inclined section 22, so that the electric door body 1 can be opened without interference.

As set forth before, according to the present embodiment, the electric door lock can have a simple structure, ensure the reliability of a locking function, reduce a danger of a failure and an operation error, and be easy to fabricate and maintain, saving the cost for the fabrication and maintenance relative to the cost taken in the related art.

In an embodiment of the present invention, the locking switch 10, the screw 15, the locking roller guide 20, and the sliding unit 30 may be respectively provided in a pair unit, in which both elements are symmetric with each other, on the door frame. This is because the door body 1 is provided in a pair unit such that both elements are opened/closed by being moved apart from or close to each other.

However, the scope of the present invention is not limited thereto, so a single door body 1 can be provided in the door frame 2. In the case that the single door body 1 is provided, it may suffice if the locking switch 10, the screw 15, the locking roller guide 20, and the sliding unit 30 respectively are concurrently provided in a single piece. Of course, even through the single door body 1 is provided on the door frame 2, the embodiment can also implement the same performance as the present embodiment.

The electric door lock according to the above embodiments of the present invention may be adapted to electric doors of railway trains, screen doors of subway stations, etc.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An electric door lock comprising:

a locking switch provided in a door frame for checking the locking state of a door body when the door body is closed, the door frame slidably supporting at least one door body;

a pair of screws capable of rotating forwards and rearwards and disposed parallel with each other in one side of the door frame in a direction towards which the door body slides;

a locking roller guide provided in the door frame in the proximity of the screws; and a slide unit wherein one end thereof is rotatably connected to one of the pair of screws and another end thereof is connected to the door body, the slide unit including a locking switch-pressing plate actuated to operate the locking switch when the door body is closed, such that a locking signal is generated by the locking switch, and a locking roller acting in combination with the locking roller guide, wherein the sliding unit includes a screw nut that is rotatably screw-coupled to one of the pair of screws such that it is movable in the longitudinal direction of the screws;

a screw nut bundle that surrounds and supports the screw nut and to which the locking switch-pressing plate and the locking roller are connected at one side; and a screw nut bundle housing that partially surrounds and supports the screw nut bundle such that the screw nut bundle can be rotated at a certain angle, wherein the screw nut bundle housing includes:

a housing body;

an opening that is formed to one side of the housing body such that the locking switch-pressing plate is exposed to the locking switch; and a through-passage that is formed in one side of the housing body to allow a support for the locking roller, which connects and supports the locking roller and screw nut bundle, to move therethrough.

2. The electric door lock of claim 1, wherein the locking roller guide comprises a guide body;

an inclined section provided at a certain angle on one surface of the guide body to define a path along which the locking roller rolls, the angle being defined in the direction towards which the door body is closed; and a vertical end formed at the utmost position of the inclined section such that the vertical end extends in the direction that vertically intersects the direction in which the door body slides.

3. The electric door lock of claim 2, when the door body is closed, the locking switch-pressing plate is actuated to operate the locking switch in response to the interaction between the locking roller and the locking roller guide, when the locking roller that is moving on the inclined section of the locking roller guide passes through the utmost position of the inclined section of the locking roller guide, it falls down towards the vertical end so that the locking roller comes into contact with or confronts the vertical end of the locking roller guide.

4. The electric door lock of claim 1, wherein the locking roller is elastically biased towards a direction against which the locking roller approaches the locking roller guide.

5. The electric door lock of claim 1, wherein the through-passage is composed of a long hole through which the locking switch-pressing plate reciprocates between a switch-off position where the door body is opened so that the locking switch is not actuated and a switch-on position where the door body is closed so that the locking switch is actuated.

6. The electric door lock of claim 1, wherein the sliding unit further comprises:

a hanger connected with the door body;

a guide roller connected to one side of the hanger and coupled to a guide rail formed on the door frame such that it is able to roll along the guide rail; and a link that connects and supports another side of the hanger and the screw nut bundle housing.

7. The electric door lock of claim 1, wherein the electric door body, the locking switch, one of the pair of screws, the locking roller guide, and the sliding unit are provided in a pair of units, respectively, in which the pair of units are symmetric with each other, on the door frame.

8. The electric door lock of claim 7, wherein the pair of screws have threads opposite to each other.

9. The electric door lock of claim 7, wherein the electric door lock further comprises a closing switch provided in the door body so as to generate a signal indicative of the locked state of the door body when the door body was closed.

10. The electric door lock of claim 1, wherein the electric door lock further comprises a space between the screw nut bundle and the screw nut bundle housing, where the screw nut bundle can move in the sliding direction of the door body or in a direction that vertically intersects the sliding direction in connection with the screw nut bundle housing.

11. An electric door system comprising the electric door lock of claim 1.

12. An electric door lock comprising:

a locking switch provided in a door frame for checking the locking state of a door body when the door body is closed, the door frame slidably supporting at least one door body;

a pair of screws capable of rotating forwards and rearwards and disposed parallel with each other in one side of the door frame in a direction towards which the door body slides;

a locking roller guide provided in the door frame in the proximity of the screws; and a slide unit wherein one end thereof is rotatably connected to the screw and another end thereof is connected to the door body, the slide unit including a locking switch-pressing plate actuated to operate the locking switch when the door body is closed, such that a locking signal is generated by the locking switch, and a locking roller acting in combination with the locking roller guide, wherein the sliding unit includes a screw nut that is rotatably screw-coupled to one of the pair of screws such that it is movable in the longitudinal direction of the screw;

a screw nut bundle that surrounds and supports the screw nut and to which the locking switch-pressing plate and the locking roller are connected at one side; and a screw nut bundle housing that partially surrounds and supports the screw nut bundle such that the screw nut bundle can be rotated at a certain angle, wherein the sliding unit further comprises:

a hanger connected with the door body;

a guide roller connected to one side of the hanger and coupled to a guide rail formed on the door frame such that it is able to roll along the guide rail; and a link that connects and supports another side of the hanger and the screw nut bundle housing, wherein the sliding unit further comprises a hinge pin that is coupled to the screw nut bundle housing and the link such that it rotatably supports the screw nut bundle housing in connection with the link.

* * * * *